US007004822B2

(12) United States Patent
Moloney et al.

(10) Patent No.: US 7,004,822 B2
(45) Date of Patent: Feb. 28, 2006

(54) CHEMICAL MECHANICAL POLISHING AND PAD DRESSING METHOD

(75) Inventors: Gerard Stephen Moloney, Milpitas, CA (US); Huey-Ming Wang, Fremont, CA (US); Peter Lao, San Jose, CA (US)

(73) Assignee: Ebara Technologies, Inc., Sacramento, CA (US)

( * ) Notice: Subject to any disclaimer, the term of this patent is extended or adjusted under 35 U.S.C. 154(b) by 89 days.

(21) Appl. No.: 10/378,024

(22) Filed: Feb. 28, 2003

(65) Prior Publication Data

US 2004/0023602 A1 Feb. 5, 2004

Related U.S. Application Data

(60) Provisional application No. 60/400,457, filed on Jul. 31, 2002.

(51) Int. Cl.
*B24B 1/00* (2006.01)

(52) U.S. Cl. ..... 451/56; 451/41; 451/63; 451/287; 451/443

(58) Field of Classification Search ..... 451/56, 451/443, 444, 285, 287, 41, 63
See application file for complete search history.

(56) References Cited

U.S. PATENT DOCUMENTS

| | | | | |
|---|---|---|---|---|
| 5,700,180 | A | 12/1997 | Sandhu et al. | |
| 5,782,675 | A * | 7/1998 | Southwick | 451/56 |
| 6,200,207 | B1 * | 3/2001 | Hsu | 451/443 |
| 6,306,008 | B1 * | 10/2001 | Moore | 451/5 |
| 6,530,827 | B2 * | 3/2003 | Mitsuhashi | 451/72 |
| 6,632,127 | B1 * | 10/2003 | Zimmer et al. | 451/285 |

* cited by examiner

*Primary Examiner*—Eileen P. Morgan
(74) *Attorney, Agent, or Firm*—Squire, Sanders & Dempsey, L.L.P.; Aaron Wininger

(57) ABSTRACT

The invention provides a chemical mechanical polishing and pad dressing method based on differing the rotational of a pad dresser, head, and/or polishing pad to improve center removal slow profiling.

14 Claims, 4 Drawing Sheets

300

| | Polishing Step | | Pad Dressing Step | |
|---|---|---|---|---|
| | Platen | Head | Platen | Dresser |
| Conventional | + | + | + | + |
| Conventional | - | - | - | - |
| Reverse I | + | + | - | - |
| Reverse II | + | + | + | - |
| Reverse III | + | + | - | + |
| Reverse IV | + | - | + | + |
| Reverse V | + | - | - | - |
| Reverse VI | + | - | + | - |
| Reverse VII | + | - | - | + |
| Reverse VIII | - | + | + | + |
| Reverse IX | - | + | - | - |
| Reverse X | - | + | + | - |
| Reverse XI | - | + | - | + |
| Reverse XII | - | - | + | + |
| Reverse XIII | - | - | + | - |
| Reverse XIV | - | - | - | + |

+ = clockwise
- = counterclockwise

FIG. 3

CHEMICAL MECHANICAL POLISHING AND PAD DRESSING METHOD

PRIORITY REFERENCE TO PRIOR APPLICATIONS

This application claims benefit of and incorporates by reference U.S. patent application Ser. No. 60/400,457, entitled "Method and Process for Chemical Mechanical Polishing to Control Wafer Removal Profile by Rotating the Polishing Pad and Pad Dressing Wheel in a Certain Direction During the Pad Dressing Step and Rotating the Polishing Pad and Wafer in an Opposite Direction During the Wafer Polish Step," filed on Jul. 31, 2002, by inventors Gerard Stephen Moloney, Huey-Ming Wang, and Peter Lao.

TECHNICAL FIELD

This invention relates generally to chemical mechanical polishing (CMP), and more particularly, but not exclusively, provides a chemical mechanical polishing and pad dressing method that improves a wafer removal profile.

BACKGROUND

CMP is a combination of chemical reaction and mechanical buffing. A conventional CMP system includes a polishing head with a retaining ring that holds and rotates a substrate (also referred to interchangeably as a wafer) against a polishing pad surface rotating in the same direction. The polishing pad can be made of cast and sliced polyurethane (or other polymers) with a filler or a urethane coated felt.

During rotation of the substrate against the polishing pad, a slurry of silica (and/or other abrasives) suspended in a mild etchant, such as potassium or ammonium hydroxide, is dispensed onto the polishing pad. The combination of chemical reaction from the slurry and mechanical buffing from the polishing pad removes vertical inconsistencies on the surface of the substrate, thereby forming an extremely flat surface. However, conventional CMP and pad dressing methods have an important shortcoming—an uneven removal profile due to a lower polishing rate at the center of a wafer than at an edge of a wafer due to non-homogenous slurry distribution on the platen 110 during CMP.

As can be seen in FIG. 1A, during pad dressing to prepare a polishing pad on a platen 110 for CMP a pad dresser 100 is rotated in the same direction as the platen 110, e.g., clockwise, which holds the polishing pad. Similarly, during CMP, as seen in FIG. 1B, a polishing head 120 that retains a wafer (not shown) is rotated in the same direction as the platen 110—also clockwise. This leads to a lower removal profile at the center of the wafer than at the edge because of non-homogenous slurry distribution on the platen 110 surfaces and beneath the wafer during CMP. Specifically, more slurry is typically distributed at the edge of the wafer than at the center of the wafer causing more CMP to occur at the edges than at the center of the wafer. The non-homogenous distribution of slurry is possibly caused by the topography of the polishing pad, which is inclined in a direction that does not easily entrap and carry the slurry particles under the wafer. Further, as the CMP technology migrates to 300 mm wafers from 200 mm wafers, non-homogenous slurry distribution becomes more pronounced, as the slurry must travel an additional distance to reach the center area of the wafer, thereby worsening the lower removal profile at the center of the wafer.

Conventional systems and methods to correct this shortcoming generally include improved polishing head designs. However, these improved polishing head designs can be expensive, complicated, and difficult to control.

Therefore, a method is needed that overcomes the above-mentioned shortcoming without the expense, complications, and control issues related to improved polishing head designs.

SUMMARY

The invention provides a method of pad dressing and chemical mechanical polishing that increases the center removal profile of a wafer without the expense, complexity and controls problems of using new polishing head designs.

The method comprises: dressing a polishing pad by rotating a pad dresser against a rotating polishing pad; dispensing a slurry onto the polishing pad; and chemically mechanically polishing a wafer by rotating a wafer against the rotating polishing pad. During the polishing and/or pad dressing, the head, polishing pad, or pad dresser rotates in a direction opposite of other rotating elements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 3 is a table illustrating the rotational directions of a platen, head, and pad dresser during pad dressing and CMP according to different embodiments of the invention;

DETAILED DESCRIPTION OF THE ILLUSTRATED EMBODIMENTS

The following description is provided to enable any person of ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1A:
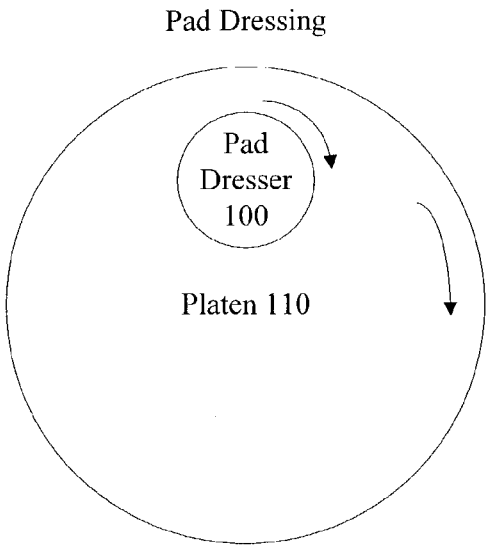
Prior Art FIG. 1A
FIGS. 1A and 1B are diagrams illustrating a pad dresser, platen, and head during conventional pad dressing and conventional CMP.
Figure 1B:
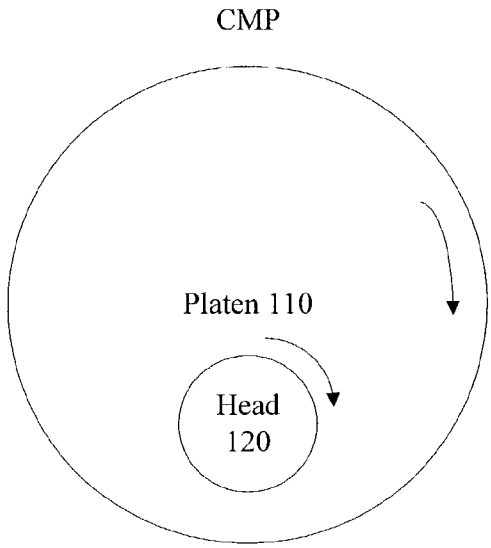
Prior Art FIG. 1B
Figure 2A:
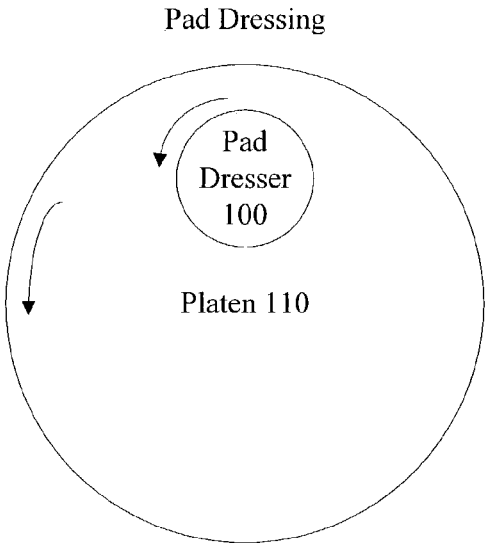
FIGS. 2A and 2B are diagrams illustrating a pad dresser, platen, and head during pad dressing and CMP according to an embodiment of the invention.
Figure 2B:
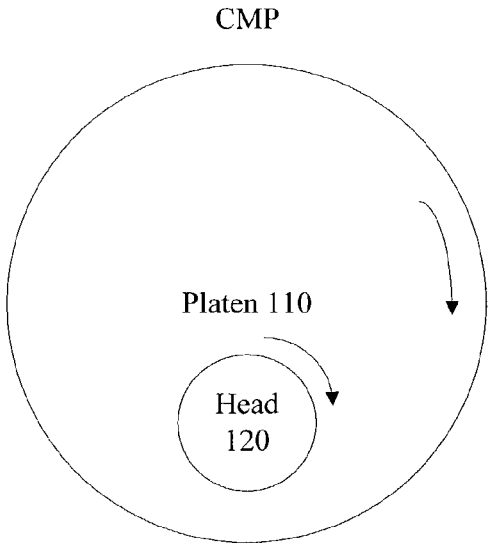

FIGS. 2A and 2B are diagrams illustrating a pad dresser 100, platen 110, and head 120 during pad dressing and CMP according to an embodiment of the invention. During pad dressing, as shown in FIG. 2A, both the pad dresser 100 and platen 110 holding a polishing pad are rotated in a counter-clockwise direction against each other. The pad dresser 100 can rotate at a speed ranging from about −5 rpm to about −200 rpm. In one embodiment of the invention, the pad dresser 100 rotates at a speed of about −40 rpm. The platen 110 can rotate at a speed from about −5 rpm to about −300 rpm. In an embodiment of the invention, the platen rotates at a speed of about −38 rpm. The rotation of both pad dresser 100 and the platen 110 can last from about 1 to about 600 seconds. In an embodiment of the invention, the rotation of the pad dresser 100 and platen 110 lasts for about 10 seconds.

After the pad dressing, the head 120 that retains a wafer and the platen 110 are both rotated in clockwise direction against each other, as shown in FIG. 2B, so as to chemically mechanically polish a retained wafer. During the CMP process, the head 120 can rotate at a speed ranging from about 5 rpm to about 250 rpm. In one embodiment of the invention, the head 120 rotates at a speed of about 60 rpm. During the CMP process, the platen 110 rotates at a speed ranging from about 5 rpm to about 250 rpm. In an embodiment of the invention, the platen 110 rotates at a speed of about 60 rpm. During polishing, both the platen 110 and the head 120 can rotate from about 5 seconds to about 600 seconds. In one embodiment of the invention, both the platen 110 and the head 120 rotate for about 2 minutes during polishing.

By rotating the pad dresser 100 and the platen 110 during pad dressing in an opposite direction from the platen 110 and the head 120 during polishing, the topography of the polishing pad on the platen 110 is inclined in a direction that can entrap the slurry particles and enable easier transportation of the slurry particles to the polishing pad surfaces underneath the center of the wafer, thereby substantially improving the center removal rate.

FIG. 3 is a table 300 illustrating the rotational directions of the platen 110, the head 120, and the pad dresser 100 during pad dressing and CMP according to different embodiments of the invention. In conventional pad dressing and CMP, the platen 110, the head 120, and the pad dresser 100 are all rotated in the same direction during pad dressing and CMP. However, in an embodiment of the present invention, at least the platen 110, the pad dresser 100 or the head 120 rotates in an opposite direction from the other elements during either pad dressing or CMP. Note that during pad dressing, the pad dresser 100 rotates against the polishing pad in the platen 110. During polishing, the head 120 rotates a wafer against the polishing pad in the platen 110.

In a first embodiment entitled "Reverse I" as shown in FIG. 2A and FIG. 2B, the pad dresser 100 and the platen 110 rotate counterclockwise during the pad dressing. During CMP, the platen 110 and the head 120 rotate in a clockwise direction.

In a second embodiment entitled "Reverse II," the platen 110 and the head 120 both rotate in a clockwise direction during CMP. During pad dressing, the pad dresser 100 rotates in a counterclockwise direction while the platen 110 rotates in a clockwise direction.

In a third embodiment entitled "Reverse III," the platen 110 and the head 120 rotate in a clockwise direction during CMP. During pad dressing, the pad dresser 100 rotates in a clockwise direction and the platen 110 rotates in a counterclockwise direction.

In a fourth embodiment entitled "Reverse IV," the platen 110 rotates in clockwise direction while the head 120 rotates in a counterclockwise direction during CMP. During pad dressing, both the pad dresser 100 and the platen 110 rotate in a clockwise direction.

In a fifth embodiment entitled "Reverse V," the platen 110 rotates in a clockwise direction while the head 120 rotates in a counterclockwise direction during CMP. During pad dressing, both the pad dresser 100 and the platen 110 rotate in a counterclockwise direction.

In a sixth embodiment entitled "Reverse VI," the platen 110 rotates in a clockwise direction while the head 120 rotates in a counterclockwise direction during CMP. During pad dressing, the platen 110 rotates in a clockwise direction while the pad dresser 100 rotates in a counterclockwise direction.

In a seventh embodiment entitled "Reverse VII," the platen 110 rotates in a clockwise direction while the head 120 rotates in a counterclockwise direction during CMP. During pad dressing, the platen 110 rotates in a counterclockwise direction while the pad dresser 100 rotates in a clockwise direction.

In an eight embodiment entitled "Reverse VIII," the platen 110 rotates in a counterclockwise direction while the head 120 rotates in a clockwise direction during CMP. During pad dressing, both the platen 110 and the pad dresser 100 rotate in a clockwise direction.

In a ninth embodiment entitled "Reverse IX," the platen 110 rotates in a counterclockwise direction while the head 120 rotates in a clockwise direction during CMP. During pad dressing, both the platen 110 and the pad dresser 100 rotate in a counterclockwise direction.

In a tenth embodiment entitled "Reverse X," the platen 110 rotates in a counterclockwise direction while the head 120 rotates in a clockwise direction during CMP. During pad dressing, the platen 110 rotates in clockwise direction and the pad dresser 100 rotates in a counterclockwise direction.

In an eleventh embodiment entitled "Reverse XI," the platen 110 rotates in a counterclockwise direction while the head 120 rotates in a clockwise direction during CMP. During pad dressing, the platen 110 rotates in counterclockwise direction and the pad dresser 100 rotates in a clockwise direction.

In a twelfth embodiment entitled "Reverse XII," both the platen 110 and the head 120 rotate in a counterclockwise direction during CMP. During pad dressing, both the platen 110 and pad dresser 100 rotate in clockwise direction.

In a thirteenth embodiment entitled "Reverse XIII," both the platen 110 and the head 120 rotate in a counterclockwise direction during CMP. During pad dressing, the platen 110 rotates in clockwise direction and the pad dresser 100 rotates in a counterclockwise direction.

In a fourteenth embodiment entitled "Reverse XIV," both the platen 110 and the head 120 rotate in a counterclockwise direction during CMP. During pad dressing, the platen 110 rotates in a counterclockwise direction and the pad dresser 100 rotates in a clockwise direction.

In the embodiments described in the table 300, during pad dressing the pad dresser 100 can rotate at a speed ranging from about 5 rpm to about 200 rpm, for example 40 rpm. The platen 110 can rotate at a speed from about 5 rpm to about 300 rpm, for example about 38 rpm. The rotation of both pad dresser 100 and the platen 110 can last from about 1 to 600 seconds, for example for about 10 seconds.

In the embodiments described in the table 300, during the CMP process the head 120 can rotate at a speed ranging from about 5 rpm to about 250 rpm, for example for about 60 rpm. During the CMP process, the platen 110 rotates at a speed ranging from about 5 rpm to about 250 rpm, for example for about 60 rpm. During polishing, both the platen 110 and the head 120 can rotate from about 0.5 seconds to about 600 seconds, for example for about 2 minutes.

Figure 4:
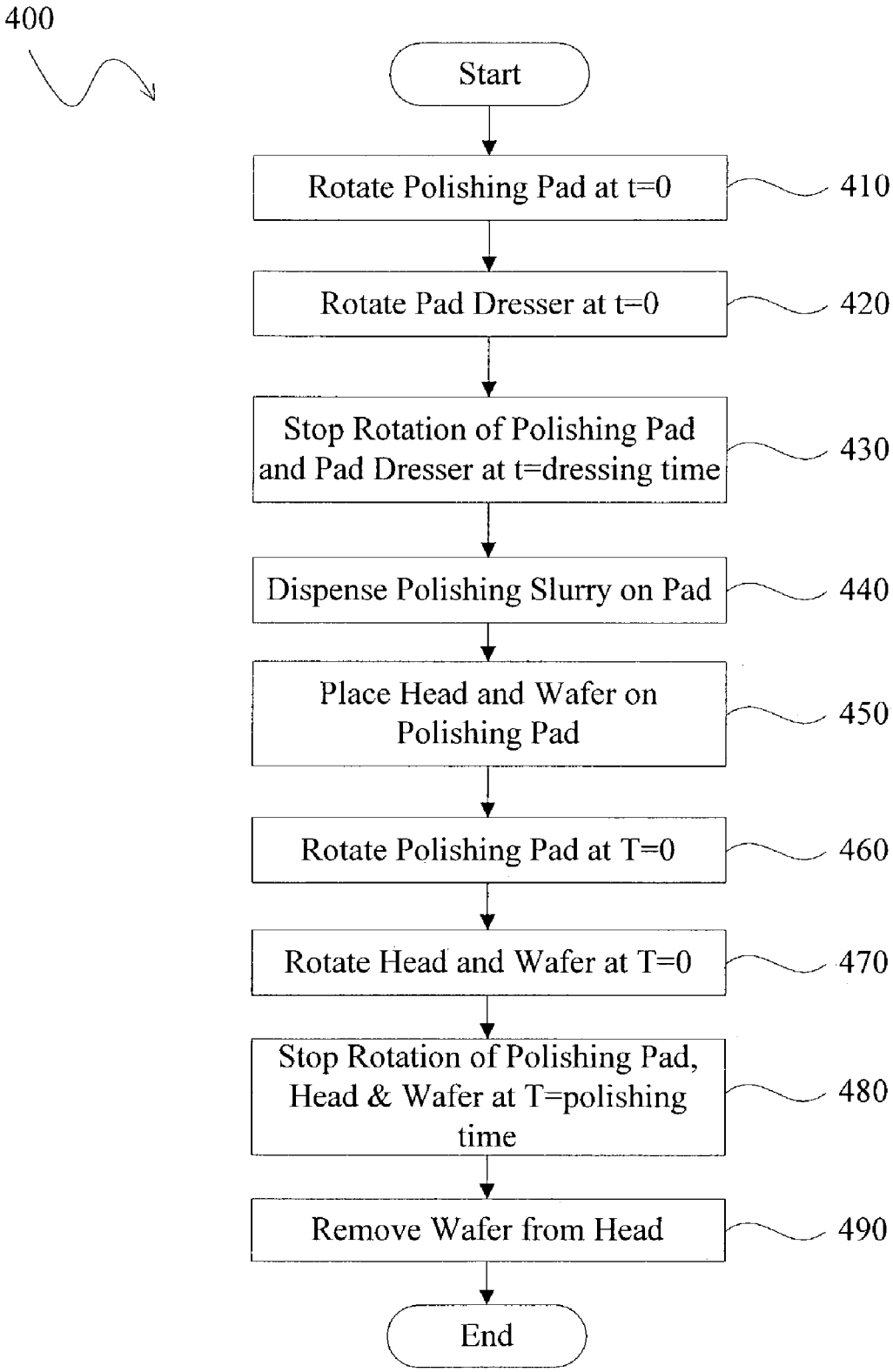
FIG. 4 is a flowchart illustrating a method of ex-situ pad dressing and CMP according to an embodiment of the invention.

FIG. 4 is a flowchart illustrating a method 400 of ex-situ pad dressing and CMP according to an embodiment of the invention. First, a pad dressing or pad preparation is performed (410–430). The pad dressing comprises rotating (410) the platen 110 that is holding a polishing pad and substantially simultaneously rotating (420) the pad dresser 100 so that the pad dresser 100 is rotating against the polishing pad in the platen 110. After a dressing time, rotation of the platen 110 and pad dresser 100 is stopped (430). The dressing time can range from about 1 to 600 seconds, e.g., 10 seconds.

After the rotation is stopped (430), slurry is dispensed (440) onto the polishing pad on the platen 110. Next, a wafer is retained by the head 120 and placed (450) on the polishing pad on the platen 110.

After the placing (450), polishing (460–480) is commenced. The polishing (460–480) comprises rotating (460) the platen 110 that holds the polishing pad and substantially simultaneously rotating (470) the head 120 that holds the wafer so that the wafer is rotated against the polishing pad. After a polishing time, the rotation (460) of the platen 110 and the rotation (470) of the head 120 are stopped (480). The polishing time can range from about 5 to about 600 seconds, e.g., 10 seconds.

The rotational directions of the pad dresser 100 and the platen 110 during pad dressing and the rotational directions of the head 120 and the platen 110 during CMP can be in any of the directions specified in the table 300. After stopping (480) the rotation, the wafer is removed (490) from the head 120 and the method 400 ends.

It will be appreciated that in another embodiment of the invention, the pad dressing and polishing can occur in-situ, i.e., the pad polishing and chemical mechanical polishing occur simultaneously. Therefore, the platen 110 must rotate in the same direction for both polishing and dressing. In order to improve wafer removal profile using in-situ dressing and polishing, the pad dresser 100 rotates only for a segment of the total polishing time.

Figure 5:
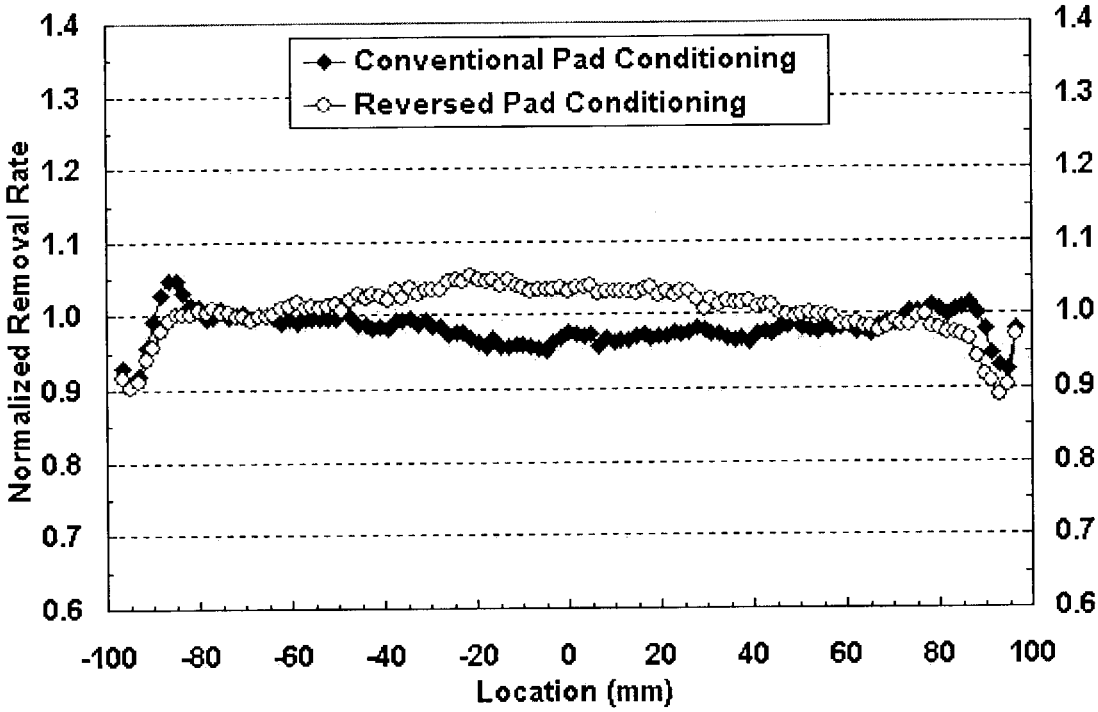
FIG. 5 is chart illustrating normalized removal rates using a conventional pad conditioning versus a reversed pad conditioning.

FIG. 5 is chart illustrating normalized removal rates using a conventional pad conditioning versus a reversed pad conditioning. Using the conventional pad conditioning (solid symbol) shows a lower normalized removal rate as compared to using the reversed pad conditioning (open symbol). Since the pad dressing (conditioning) recipe (i.e., down force and linear velocity) remain the same between conventional and reversed pad conditioning, there should be no decrease in pad polishing life (as only rotational direction changes). Further, polishing pad life may increase as the reversed pad conditioning is more efficient than conventional pad conditioning. Further, by using reversed pad conditioning (i.e., conditioning in the opposite direction of CMP), it is possible to control the pad topography and thus control the overall wafer polishing profiles, thereby possibly eliminating the need for zone control or other profile control heads.

The foregoing description of the illustrated embodiments of the present invention is by way of example only, and other variations and modifications of the above-described embodiments and methods are possible in light of the foregoing teaching. For example, the method can be applied to both linear polishing and rotational polishing methods. Further, the pad conditioning (dressing) can be in-situ, ex-situ, or a combination of in-situ and ex-situ. The embodiments described herein are not intended to be exhaustive or limiting. The present invention is limited only by the following claims.

What is claimed is:

1. A chemical mechanical polishing and pad dressing method, comprising:

dressing a polishing pad by rotating a pad dresser against a rotating polishing pad, the rotating polishing pad rotating in a first rotational direction;

dispensing a slurry onto the polishing pad;

reversing the rotation of the rotating polishing pad, so that the rotating polishing pad rotates in a second rotational direction opposite the first rotational direction; and chemically mechanically polishing a wafer by rotating the wafer against the rotating polishing pad, while the rotating polishing pad rotates in the second rotational direction wherein the rotational combinations I, III, V–VIII, and X–XIII are defined as

| | Polishing | | Pad Dressing | |
|---|---|---|---|---|
| Rotational Combination | Polishing Pad | Head | Polishing Pad | Dresser |
| I | + | + | − | − |
| III | + | + | − | + |
| V | + | − | − | − |
| VI | + | − | + | − |
| VII | + | − | − | + |
| VIII | − | + | + | + |
| X | − | + | + | − |
| XI | − | + | − | + |
| XII | − | − | + | + |
| XIII | − | − | + | − |

wherein "+" refers to clockwise rotation and "−" refers to counterclockwise rotation.

2. The method of claim 1, wherein the dressing occurs for about 1 to about 600 seconds.

3. The method of claim 1, wherein the dressing occurs for about 10 seconds.

4. The method of claim 1, wherein the polishing occurs for about 5 to about 600 seconds.

5. The method of claim 1, wherein the polishing occurs for about 10 seconds.

6. The method of claim 1, wherein the polishing occurs ex-situ.

7. The method of claim 1, wherein the polishing occurs in-situ.

8. The method of claim 1, wherein the polishing pad rotates within a range of about 5 rpm to about 250 rpm during the polishing.

9. The method of claim 1, wherein the wafer rotates within a range of about 10 rpm to about 250 rpm during the polishing.

10. The method of claim 1, wherein the wafer and the polishing pad both rotate at a rate of about 60 rpm during polishing.

11. The method of claim 1, wherein the pad dresser rotates within a range of about 5 to about 300 rpm during dressing.

12. The method of claim 1, wherein the polishing pad rotates within a range of about 5 rpm to about 100 rpm during the dressing of the polishing pad.

13. The method of claim 1, wherein the pad dresser rotates at about 40 rpm during dressing and the polishing pad rotates at about 38 rpm during dressing.

14. The method of claim 1, further comprising:

after the dressing and before the dispensing, stopping rotation of the pad dresser and of the polishing pad;

wherein the polishing the wafer comprises retaining a wafer after the dispensing.

* * * * *

UNITED STATES PATENT AND TRADEMARK OFFICE

CERTIFICATE OF CORRECTION

PATENT NO. : 7,004,822 B2
APPLICATION NO. : 10/378024
DATED : February 28, 2006
INVENTOR(S) : Moloney et al.

It is certified that error appears in the above-identified patent and that said Letters Patent is hereby corrected as shown below:

Column 5, Line 57

Claim 1 should read as follows:

--1. A chemical mechanical polishing and pad dressing method, comprising:

dressing a polishing pad by rotating a pad dresser against a rotating polishing pad, the rotating polishing pad rotating in a first rotational direction;

dispensing a slurry onto the polishing pad;

reversing the rotation of the rotating polishing pad, so that the rotating polishing pad rotates in a second rotational direction opposite the first rotational direction; and chemically mechanically polishing a wafer by rotating the wafer against the rotating polishing pad, while the rotating polishing pad rotates in the second rotational direction.--

Signed and Sealed this

Seventeenth Day of April, 2007

JON W. DUDAS
*Director of the United States Patent and Trademark Office*